US005453589A

United States Patent [19]

Mayer

[11] Patent Number: 5,453,589

[45] Date of Patent: Sep. 26, 1995

[54] MICROSWITCH WITH NON-ENLARGING, SEALED ELECTRICAL CONNECTIONS

[75] Inventor: Wolfgang Mayer, Haar, Germany

[73] Assignee: Schaltbau Aktiengesellschaft, Munich, Germany

[21] Appl. No.: 221,807

[22] Filed: Apr. 1, 1994

[30] Foreign Application Priority Data

Apr. 2, 1993 [DE] Germany ..... 9305073 U

[51] Int. Cl.[6] ..... H01H 9/04

[52] U.S. Cl. ..... 200/302.1; 439/177

[58] Field of Search ..... 200/302.2, 302.1; 439/177, 936

[56] References Cited

U.S. PATENT DOCUMENTS

| | | | |
|---|---|---|---|
| 2,814,704 | 11/1957 | Bald | 200/302.2 |
| 4,370,009 | 1/1983 | Dola | 439/177 |
| 4,789,359 | 12/1988 | Sawada . | |
| 4,793,820 | 12/1988 | Czech et al. | 439/177 |
| 4,877,930 | 10/1989 | Fukuma | 200/302.2 |

FOREIGN PATENT DOCUMENTS

| | | |
|---|---|---|
| 0344800 | 2/1989 | European Pat. Off. . |
| 1465355 | 11/1972 | Germany . |
| 3616525A1 | 5/1986 | Germany . |
| 9011926 U | 8/1990 | Germany . |

*Primary Examiner*—Renee S. Luebke
*Attorney, Agent, or Firm*—Graybeal Jackson Haley & Johnson

[57] ABSTRACT

A microswitch with a housing and base from which connection contacts project which are adapted to be sealed with respect to the housing by means of a sealing compound and which include receptors for connecting electrical lines thereto. The microswitch is usable under different environmental conditions and with as many identical structural components as possible without causing any change in the overall size. For receiving the sealing compound, the base is provided with a troughlike recess which is surrounded by walls on at least three sides, with the connection contacts each having a separating line extending within the recess and with each being cuttable to length at this separating line in such a way that the remaining residual parts still end within the recess. The remaining residual parts are also provided with receptors for connecting electrical lines thereto.

11 Claims, 4 Drawing Sheets

MICROSWITCH WITH NON-ENLARGING, SEALED ELECTRICAL CONNECTIONS

Figure 1:
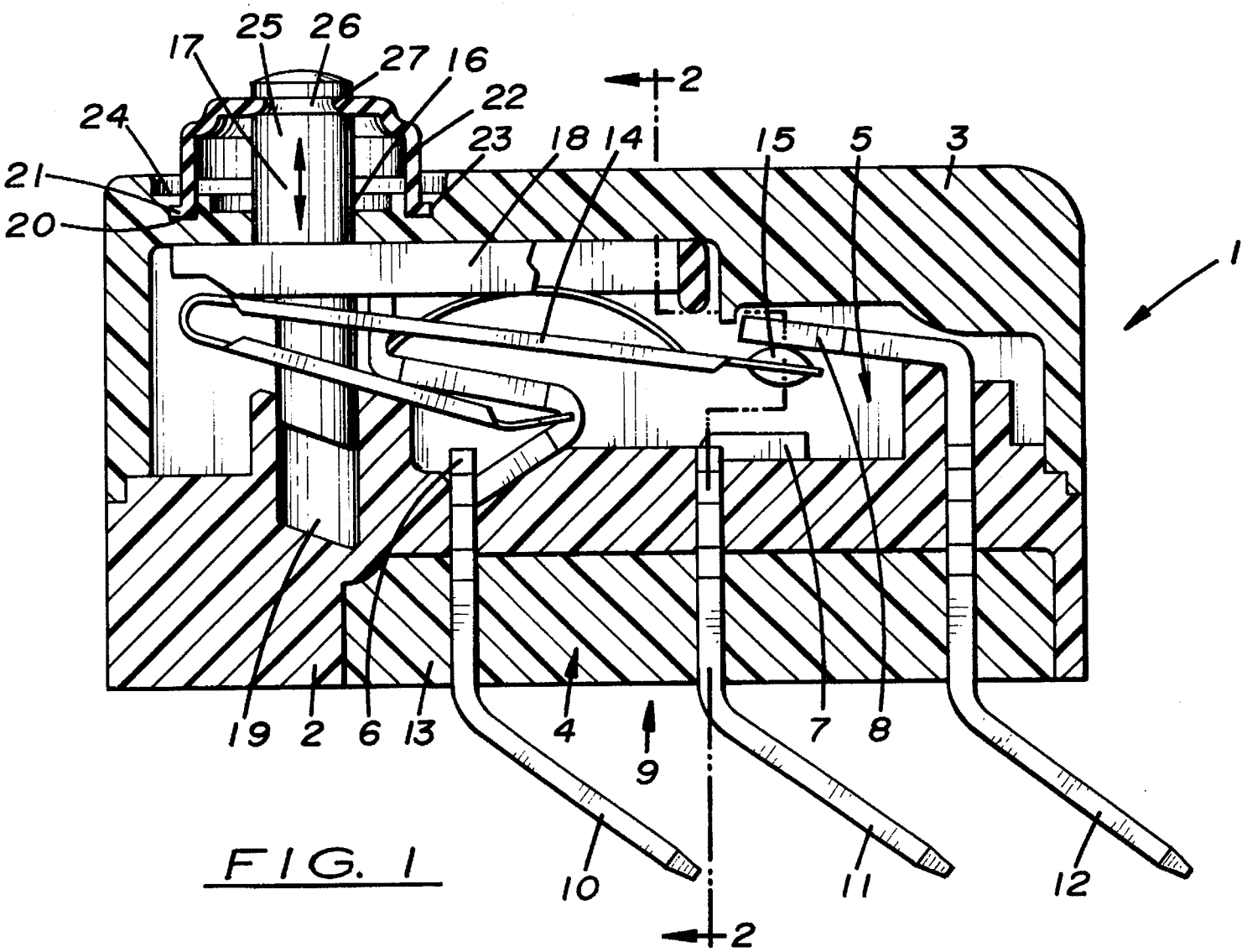

The present invention refers to a microswitch having a housing provided with a base from which connection contacts project, which are adapted to be sealed with respect to the housing by means of a sealing compound and which include reception means for connecting electric lines thereto.

These microswitches are used in the field of industry, in the field of car manufacture, and in telecommunication engineering. In particular microswitches of this type frequently have to fulfil varying requirements which are due to environmental factors. The requirements are classified in DIN 40050 in socalled IP classes differentiating between protection against electric shock, protection against the ingress of solid foreign bodies, and protection against the ingress of water. It turned out that the sealing means required for a higher protection class necessitate either a modified design or an increase of the external dimensions of the switch due to additional parts which are required for producing the sealing effect. On the one hand, this will entail higher costs, which result from the production and the assembly of additional parts, and, on the other hand, problems will arise with respect to the exchangeability of different types of a microswitch, in particular in products having a compact structural design.

A microswitch of the type above mentioned is known as in German Patent G 9011926.6., dated Jan. 3, 1991. In the case of the microswitch described in said publication, connection contacts project from the housing on the lower connection side. For sealing the connection contacts, which have electric lines soldered thereto, the connection side is inserted in a troughlike component, whereupon the cavity defined by the troughlike component and the connection side is filled with a sealing compound. The overall size of the microswitch is enlarged by the additional troughlike component.

It is the object of the present invention to provide microswitches which are adapted to be used under different environmental conditions and for which as many identical structural components as possible are used without causing any change in the overall size.

In accordance with the present invention, this object is achieved by the features that, for receiving the sealing compound, the base is provided with a troughlike recess which is surrounded by walls on at least three sides thereof, that the connection contacts each have a separating line extending within the recess, and that they are adapted to be cut to length at this separating line in such a way that the remaining residual parts of the connection contacts end still within the recess, said remaining residual parts of the connection contacts being also provided with reception means for connecting electric lines thereto.

Due to the fact that the troughlike recess in the base is filled with a sealing compound, the protruding contacts are sealed with respect to the housing, the overall size remaining unchanged. In this way, a dustproof version of the switch is obtained. In order to seal the connection contacts hermetically against the ingress of water (see protection class IP-67), the identical connection contacts can be cut to length along one separating line in such a way that the residual parts of the connection contacts do not project beyond the edge of the troughlike recess. In the course of this cutting operation, reception means are simultaneously produced, which are open at the top and which are used for connecting electric lines thereto, said reception means being adapted to have secured thereto strands by means of soldering. When the lines have been connected, the troughlike recess is filled with a sealing compound, and this will have the effect that the connected residual parts of the connection contacts are sealed completely with respect to the housing consistent with the IP-67 requirement. In view of the fact that the residual parts of the connection contacts do not project beyond the troughlike edge at any point, the overall size of the microswitch remains unchanged. Also the structural design of the tools can be modular for this embodiment of a microswitch, since the residual parts of the connection contacts remaining in the base can be produced from the identical connection contacts by means of a progressive cut. The various bases can be produced by exchanging inserts in an injection moulding tool, for example.

It will be particularly advantageous when the reception means in the remaining residual parts of the connection contacts are constructed as openings, and when the separating line of the connection contacts extends through the openings so that, when said connection contacts have been cut to length, solder reception means will be formed, which are open at the top and into which the lines can be inserted from above and secured in position by soldering.

Making use of this structural design, it will be essentially less difficult to insert the wires in the solder reception means than in cases in which said wires have to be threaded through soldering eyelets and then secured in position by soldering.

It will be advantageous to provide the openings with an essentially triangular shape so that, when the connection contacts have been cut to length, solder reception means will be formed, which are essentially V-shaped. This V-shape will again facilitate insertion of the wires from above, since said wires will thus be centered and simultaneously clamped, whereby the soldering process will be facilitated.

A bell-shaped opening used for connecting electric lines can advantageously offer, in addition to the simple insertion from above, the centering and the clamping caused by a slight V-shape of the sides of the bell-shaped reception means, a shape which is well suited for soldering and which is adapted to the cross-section of the lines.

It will be particularly advantageous, when the separating line of the connection contacts extends by the side of the openings such that it is displaced towards the base so that a lateral recess will be formed by the side of the openings and the solder reception means, which is formed as a result of the cutting operation, will project in comparison with the remaining residual parts of the connection contacts. By means of this recess, the connection lines can be guided past the contacts adjacent thereto so that they will not project from the underside of the housing.

In accordance with an advantageous embodiment, part of the connection contacts can be constructed such that the reception means used for connecting electric lines thereto are laterally displaced relative to the longitudinal center of the respective connection contacts. This has the advantage that all electric lines can be guided such that they leave the housing in a common plane.

One can provide a troughlike recess which is enclosed by walls only on three sides thereof so that it is possible to guide the electric lines out of the housing through the opening remaining at the fourth side; this possibility is moderate in price and simple.

The housing is preferably constructed as a two-part housing consisting of a cover and a base, said cover being adapted to be connected to said base by ultrasonic welding. In view of the fact that the cover and the base are produced from plastic material in an injection moulding process in most cases, ultrasonic welding rather than glueing should preferentially be used. Ultrasonic welding can be automated more easily, and, consequently, it is faster and thus less expensive than glueing. Due to the identical structural design, it is, moreover, possible to exchange the covers of different bases.

The cover of the housing may preferably have an opening which is in alignment with a blind hole provided in the base. A switching tappet, which is adapted to be operated from outside, can be guided in the opening and in the blind hole. Two guiding supports are thus formed, which are particularly well suited for preventing the switching tappet from tilting and from getting stuck during the switching operation.

In the case of weak switching forces, it may occasionally happen that the switching contacts weld at poor switching contact points within the switch, and this may have the effect that said switching contacts can perhaps no longer be switched by means of the operating elements. In a microswitch according to the present invention, this problem can be solved by connecting the switching tappet to a forced-separation lever, which presses directly onto a movable switching contact after a predetermined stroke of the tappet. The welds which may perhaps occur can thus be torn.

For sealing the rubber bellows relative to the housing, a clamping ring can be inserted, which is connected to the housing by means of welding or glueing. In order to make this additional part superfluous, a microswitch according to the present invention may be provided with the features that a switching tappet, which is adapted to be operated from outside, projects beyond an opening of the housing, with said opening being surrounded by an annular groove on the outer side of the housing and a rubber bellows, which has a lower L-shaped edge provided with a circumferentially extending lip which is directed radially outwards, being adapted to be inserted into said annular groove, and the outer edge of said groove being adapted to be deformed radially inwards by means of ultrasonic stamping, the circumferentially extending lip being sealingly clamped in the groove by said deformed groove edge.

Figure 2:
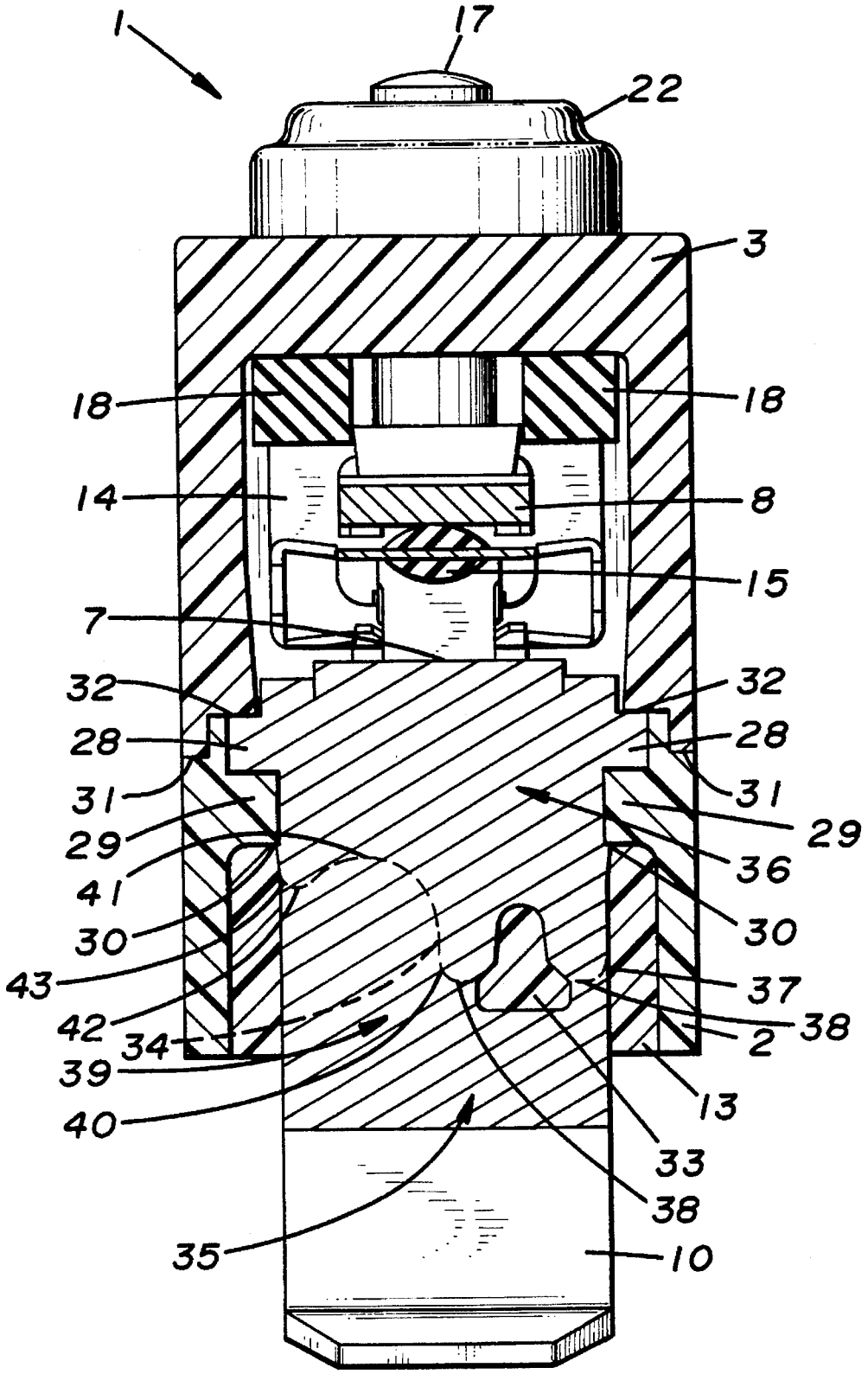
Figure 3:
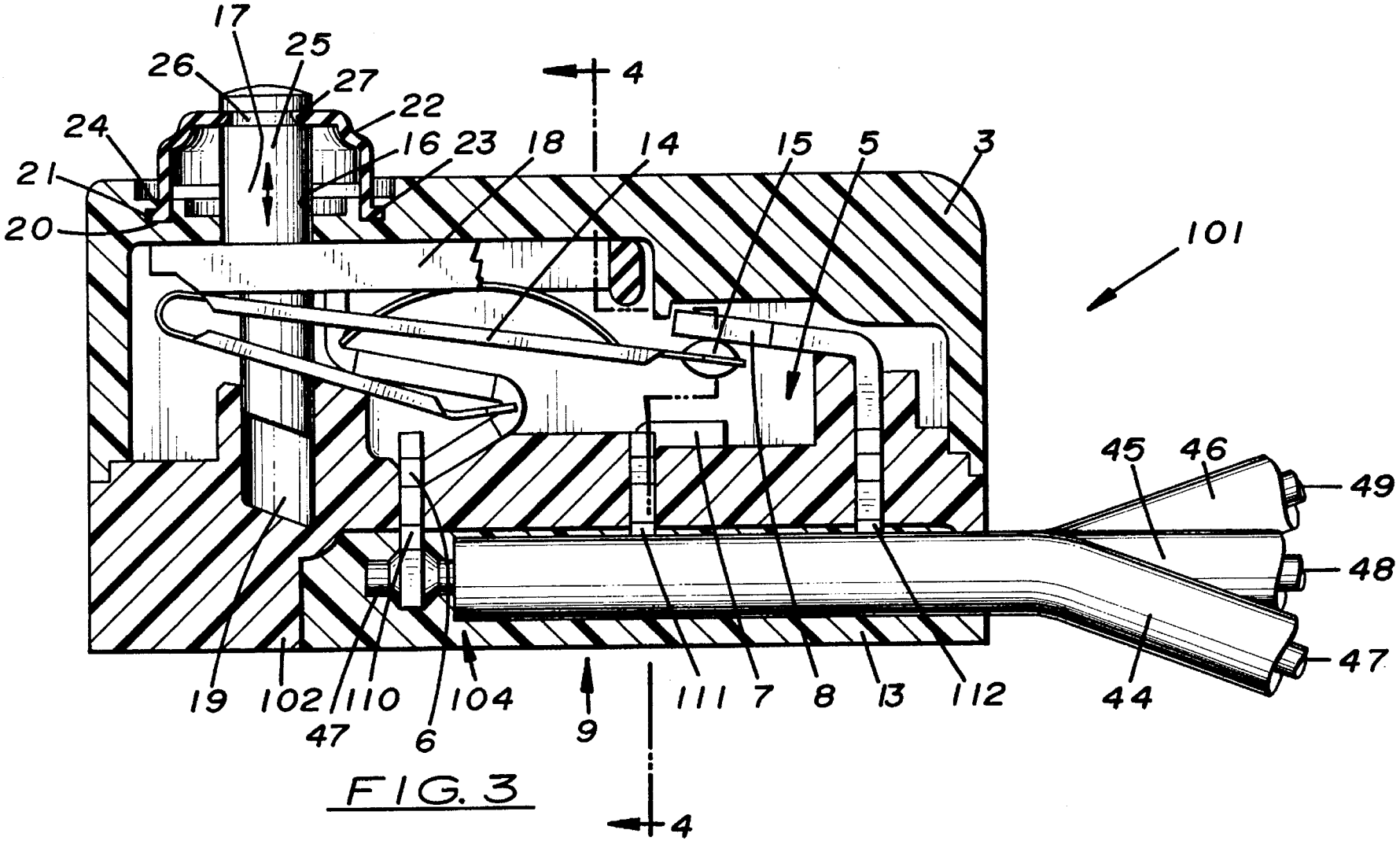
Figure 4:
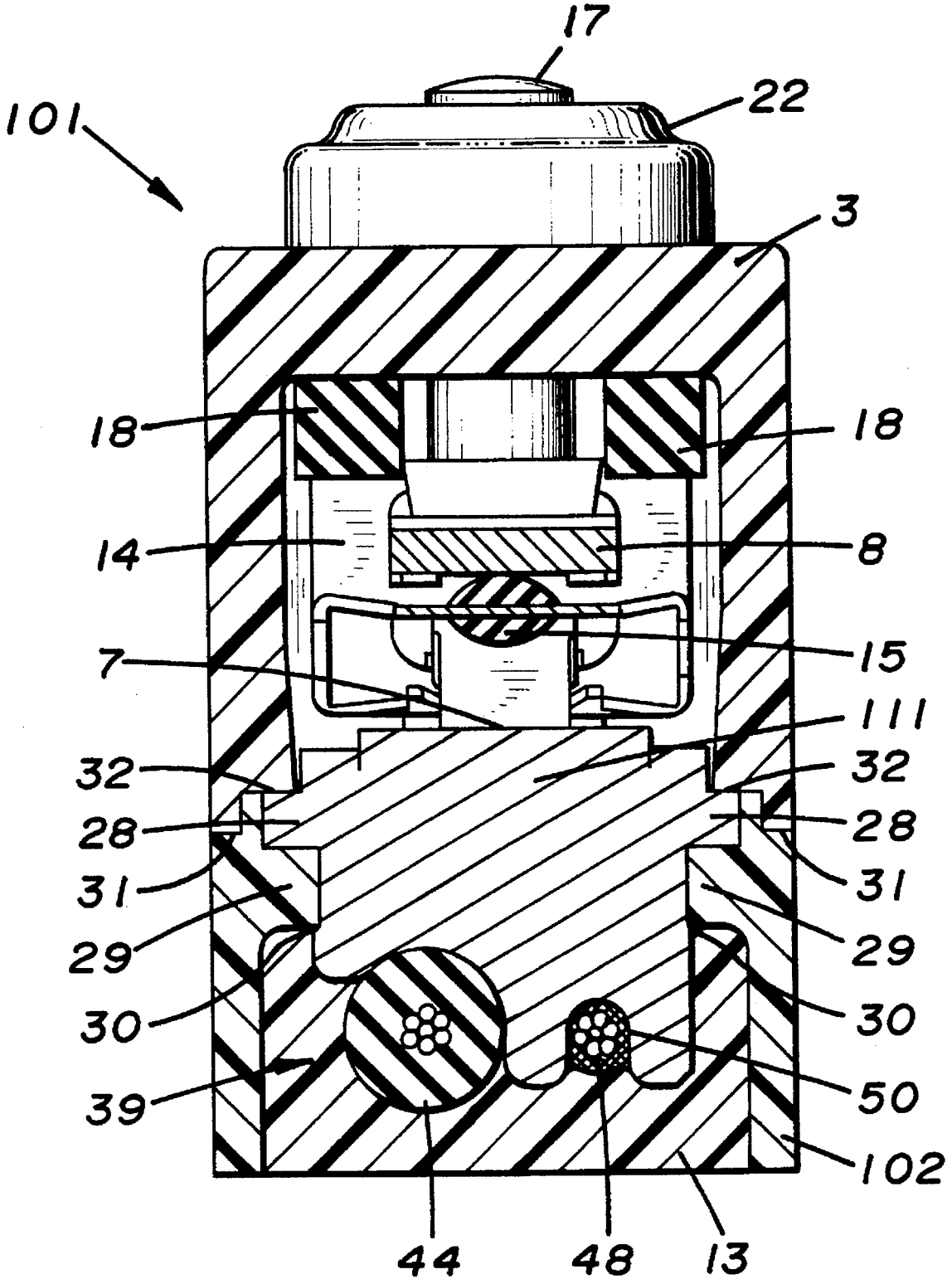

These and other advantages resulting from the microswitch according to the present invention are explained in detail on the basis of a plurality of embodiments shown in the drawings enclosed, in which FIG. 1 shows a longitudinal section through a microswitch according to the present invention, FIG. 2 shows a cross-section through the microswitch according to the present invention along the sectional line II—II of FIG. 1, said cross-section being shown in an enlarged representation for the sake of clarity, FIG. 3 shows a longitudinal section through a microswitch with a modified base according to the present invention, FIG. 4 shows a cross-section through the microswitch according to the present invention according to the sectional line IV—IV of FIG. 3, said cross-section being shown in an enlarged representation for the sake of clarity.

FIG. 1 discloses a microswitch comprising a housing 1 which is composed of a base 2 and of a cover 3.

On the underside of the base 2, a troughlike recess 4 is formed, which is enclosed by walls on four sides. The base 2 has inserted therein switching contacts 6, 7 and 8 on an upper switching side 5, which, on a lower connection side 9, project vertically downwards beyond the troughlike recess 4 as connection contacts 10, 11 and 12 and which are bent to the right at an obtuse angle. The troughlike recess 4 is filled with a sealing compound 13 sealing the connection contacts 10, 11 and 12 with respect to the base 2.

On the switching side of the base 2, the switching contacts 7 and 8 are arranged one on top of the other on the right-hand side. The switching contact 6 has secured thereto a movable switching contact 14, which has been punched out of a metal sheet and which is bent into a clasplike shape. The outer end of the movable switching contact 14 is provided with spherical contact caps 15 on the lower and on the upper side thereof, said outer end of the movable switching contact 14 being located between the two switching contacts 7 and 8, and is in the upper position in contact with the switching contact 8.

The cover 3 has an opening 16 on its upper side, with a movable switching tappet 17 being vertically guided in said opening 16. This switching tappet 17 has secured thereto a horizontally supported forced-separation lever 18 within the housing 1, which, due to the spring effect of the movable switching contact 14, is held directly below the cover 3 in its uppermost position. A vertical extension of the switching tappet 17 is also guided in a blind hole 19 in the base 2, said blind hole 19 being in alignment with the opening 16 of the cover 3. The switching tappet 17 acts on the movable switching contact 14.

The opening 16 in the cover 3 is surrounded by an annular groove 20 on the upper side thereof, said groove 20 having inserted therein the lower edge 21 of a rubber bellows 22. Said lower edge 21 has an L-shaped form with a lip 23 which is directed radially outwards. Material of the outer groove edge 24 has been deformed inwards by means of ultrasonic stamping, the circumferentially extending lip 23 being sealingly clamped in position in the groove 20.

The switching tappet 17 has in the upper area 25, which projects above the cover 3, a circumferentially extending channel 26 having inserted therein the upper edge 27 of the rubber bellows. In view of the fact that the width of said channel 26 is smaller than the wall thickness of the rubber bellows 22 at the upper edge 27 and in view of the fact that the diameter of the circumferentially extending channel 26 is larger than the diameter of the upper edge 27 of the rubber bellows 22, said upper edge of the rubber bellows 27 is sealingly clamped in position by means of a press fit.

FIG. 2 shows a sectional drawing according to line II—II of FIG. 1. The switching contacts 6, 7 and 8 (contact 7 being shown in FIG. 2) each have in the upper part thereof two rectangular protrusions 28, which protrude on both sides and which rest on projections 29 provided on the base 2. Below the projections 29, each of the switching contacts 6, 7 and 8 is in upward engagement with said projections 29 by means of two barbs 30 so as to prevent axial displacement in the vertical direction. The cover 3 has on its underside 31 a shoulder 32 extending circumferentially on the inner side and resting on the projecting protrusions 28 of the switching contacts 6, 7 and 8 from above. The underside 31 of the cover 3 is connected to the base 2 by ultrasonic welding.

The connection contacts 10, 11 and 12 (contact 10 being shown in FIG. 2) each have a bell-shaped opening 33, which is located within the troughlike recess 4 and which is laterally displaced relative to the longitudinal axis of the respective connection contacts. An imaginary separating line 34 extends through this opening 33, said separating line 34 subdividing the connection contacts 10, 11 and 12 into the separable area 35 and the non-separable area 36.

In FIG. 2, the course of the separating line 34 is shown on the basis of the contact 11; the separating line extends from the right edge 37 of the respective connection contact in a horizontal part 38 through the broadest portion of the opening 33 up to approximately the longitudinal axis of the respective switching contact. The continued course of this separating line 34 delimits a lateral recess 39 which is located on the left-hand side adjacent the opening 33. This part of the course of the separating line 34 begins at the longitudinal axis, the horizontal part 38 merging upwards with a vertical part 40. Approximately on the level on which the centre of the opening 33 is located, this vertical part 40 merges tangentially with a 140° circular section 41, the outer diameter of said circular section 41 corresponding to approximately half the width of a switching contact. The end of the circular section 41 merges with a curved transition portion 42 extending towards the left edge 43 of the respective connection contact.

In switching contact 10, the lateral recess 39 is arranged adjacent the associated opening 33 on the right-hand side thereof; this cannot be seen in the drawing. The opening 33 of switching contact 12 is centrally arranged.

FIG. 3 and 4 show a further embodiment of the microswitch. Identical reference numerals have been used for identical or similar structural components. In the following, only the differences existing in comparison with the above embodiment (FIG. 1, FIG. 2) are discussed.

On the underside of a base 102, a troughlike recess 104 is formed, which is enclosed by walls on only three sides thereof. Instead of the fourth wall (see in this respect base 2 in FIG. 1), electric lines 44, 45 and 46 are horizontally guided out of a housing 101 through an opening defined on the right-hand side of the base 102. Instead of the connection contacts 10, 11 and 12 (see FIG. 1), residual parts 110, 111 and 112 of the connection contacts 10, 11 and 12 which have been cut to length, project into the troughlike recess 104, with said residual parts not projecting beyond the edge of the recess 104. The strands 47, 48 and 49 of the electric lines 44, 45 and 46 are soldered to the respective residual parts 110, 111 and 112. The troughlike recess 104 is filled with a sealing compound 13. This has the effect that, on the one hand, the residual parts 110, 111 and 112 are sealed with respect to the housing 101. On the other hand, this also has the effect that the electric lines 44, 45 and 46 which are soldered to the residual parts 110, 111 and 112 are sealed toward the outside.

In FIG. 4, the residual parts 110, 111 and 112, instead of the connection contacts 10, 11 and 12, project beyond the base 102 into the troughlike recess 104. These residual parts of the connection contacts have been cut to length at the separating line 34 described in connection with the form of microswitch shown in FIG. 2. Instead of the bell-shaped opening 33, the connection parts 110, 111 and 112 have a solder reception means 50 which is open at the bottom, the respective electric lines 44, 45 and 46 with their strands 47, 48 and 49 being soldered into the respective solder reception means 50.

In the lateral recess 39 (FIG. 4), which has been produced at the contact 111 by the separating line 34 during the cutting operation, the electric line 44 soldered to the contact 110 is guided past said solder reception means 50 adjacent thereto. At the contact 112, the two lines 44 and 46 are then guided past the solder reception means of the contact 112 laterally adjacent thereto.

In the following, the mode of operation of the microswitch will be described.

When the switching tappet 17 is actuated such that it moves into the housing 1, it will urge the movable switching contact 14 downward. As soon as the upper part of the movable switching contact 14 passes beyond the switch point, the outer end of the movable switching contact with the spherical contact caps 15 snaps downward. The movable switching contact is now connected to switching contact 7. In the starting position, the connection contacts 10 and 12 are interconnected; in the switched position, the connection contacts 10 and 11 are interconnected.

When the switch is released, the system snaps back into its starting position. If the movable switching contact 14 is welded to the switching contact 8, the switching forces can, after a predetermined stroke of the tappet, be transmitted directly via the forced-separation lever 18 to the movable end of the switching contact 14, whereby the weld is torn.

The modular design of the microswitch permits an adaptation to various IP classes by slightly modifying the structural components of the housing 1 of the microswitch.

The microswitch disclosed in the first embodiment in FIGS. 1 and 2 is provided with connection contacts 10, 11 and 12, which are sealed only with respect to the housing 1. In order to seal these connection contacts 10, 11 and 12 even according to the IP-67 class requirements, a small number of modifications will suffice.

The connection contacts 10, 11 and 12 only have to be cut to length at the separating line 34 by means of a progressive cut before they are installed in the base 2. The resultant residual parts 110, 111 and 112 then no longer project beyond the housing. The strands 47, 48 and 49 can now be inserted in the resultant respective solder reception means 50 and secured in position by soldering. When the troughlike recess 4 is now filled with the sealing compound 13, also the soldered joints within the recess are sealed.

If the electric lines 44, 45 and 46 are to be arranged such that they do not extend downward, but to the side of the housing 1, a modified base 102 will be used, which has an opening instead of one of the walls. The electric lines 44, 45 and 46 can thus be guided within the troughlike recess 104 past the recesses 39 of the residual parts of the connection contacts 110, 111 and 112 laterally adjacent to said recesses 39 and then through the opening in the housing 1 to the outside. For modifying the base, also the structural design of the tools can be modular by constructing the inserts in the injection moulding tool for the troughlike recess 4 and 104 such that they are replaceable.

It would also be possible to produce a microswitch without protection, i.e. according to protection class IP-00, which is not described in these embodiments, by means of the modular tools. For this purpose, a housing 1 would be required from which the connection contacts 10, 11 and 12 and the switching tappet 17 project without any sealing whatsoever. The rubber bellows 22 would not be provided in this case so that the insert in the injection moulding tool, which would otherwise be necessary for the annular groove 20, can be removed. The connection contacts 10, 11 and 12 need no longer be sealed with respect to the housing 1 by means of a sealing compound 13 so that, in this case, it will also be possible to remove the insert in the injection moulding tool which serves to produce the troughlike recess 4 in the base 2. This combination and further combinations with respect to the protection classes are, of course, also imaginable.

I claim:

1. A microswitch having a housing provided with a base from which connection contacts project, which are adapted to be sealed with respect to the housing by means of a sealing compound and which include reception means for connecting electric lines thereto, characterized in that, for receiving the sealing compound, the base is provided with a troughlike recess which is surrounded by walls on at least three sides thereof, that the connection contacts each have a separating line extending within the recess and that they are adapted to be cut to length at this separating line in such a way that the remaining residual parts of the connection contacts end still within the recess, said remaining residual parts of the connection contacts being also provided with reception means for connecting electric lines thereto.

2. A microswitch according to claim 1, characterized in that the reception means in the remaining residual parts of the connection contacts are constructed as openings, and that the separating line of the connection contacts extends through the openings so that, when said connection contacts have been cut to length, said reception means are formed, which are open at the top and into which the lines can be inserted from above and secured in position by soldering.

3. A microswitch according to claim 2, characterized in that the openings have an essentially triangular shape so that, when said connection contacts have been cut to length, the solder reception means are formed, which are essentially V-shaped.

4. A microswitch according to claim 2, characterized in that said reception means, which is used for connecting thereto electric lines, is constructed as an essentially bell-shaped opening.

5. A microswitch according to claim 2, characterized in that the separating line of the connection contacts extends by the side of the openings such that it is displaced toward the base so that a lateral recess is formed by the side of the openings and the solder reception means, which is formed as a result of the cutting operation, projects in comparison with the remaining residual parts of the connection contacts.

6. A microswitch according to claim 1, characterized in that in part of the connection contacts the reception means used for connecting thereto electric lines are arranged such that they are laterally displaced relative to the longitudinal center of the respective connection contacts.

7. A microswitch according to claim 1, characterized in that the troughlike recess is enclosed by walls only on three sides thereof.

8. A microswitch according to claim 1, characterized in that the housing is constructed as a two-part housing consisting of a cover and a base, said cover being adapted to be connected to said base by ultrasonic welding.

9. A microswitch according to claim 8, characterized in that the cover of the housing has an opening and the base has a blind hole which is in alignment with said opening, and a switching tappet which is adapted to be operated from outside, extending through said blind hole as well as through said opening.

10. A microswitch according to claim 9, characterized in that the switching tappet is connected to a forced-separation lever within the housing, said forced-separation lever pressing directly onto a movable switching contact after a predetermined stroke of the tappet.

11. A microswitch according to claim 1, characterized in that a switching tappet, which is adapted to be operated from outside, projects beyond an opening of the housing, said opening being surrounded by an annular groove on the outer side of the housing and a rubber bellows which has a lower L-shaped edge provided with a circumferentially extending lip which is directed radially outwardly, being adapted to be inserted into said annular groove, and the outer edge of said groove being adapted to be deformed radially inwardly by means of ultrasonic stamping, the circumferentially extending lip being sealingly clamped in the groove by said deformed groove edge.

* * * * *